US008826974B2

(12) United States Patent
Lehr et al.

(10) Patent No.: US 8,826,974 B2
(45) Date of Patent: Sep. 9, 2014

(54) INTEGRATED CONTINUOUS LINER EXPANSION METHOD

(75) Inventors: Joerg Lehr, Celle (DE); Anja Erdmann, Celle (DE); Keven O'Connor, Houston, TX (US); Ines Gruetzmann, Lehrte-Arpke (DE)

(73) Assignee: Baker Hughes Incorporated, Houston, TX (US)

( * ) Notice: Subject to any disclaimer, the term of this patent is extended or adjusted under 35 U.S.C. 154(b) by 421 days.

(21) Appl. No.: 13/215,934

(22) Filed: Aug. 23, 2011

(65) Prior Publication Data

US 2013/0048308 A1 Feb. 28, 2013

(51) Int. Cl.
*E21B 43/10* (2006.01)
*E21B 17/14* (2006.01)

(52) U.S. Cl.
CPC ..... *E21B 43/103* (2013.01); *E21B 17/14* (2013.01); *E21B 43/105* (2013.01)
USPC ..... 166/207; 166/212; 166/384; 166/380

(58) Field of Classification Search
CPC ..... E21B 43/103
USPC ..... 166/380, 207–212, 179–203, 384, 387
See application file for complete search history.

(56) References Cited

U.S. PATENT DOCUMENTS 5,348,095 A * 9/1994 Worrall et al. ..... 166/380
6,328,113 B1 12/2001 Cook
6,470,966 B2 10/2002 Cook et al.
6,557,640 B1 5/2003 Cook et al.
6,561,227 B2 5/2003 Cook et al.
6,568,471 B1 5/2003 Cook et al.
6,575,240 B1 6/2003 Cook et al.
6,604,763 B1 8/2003 Cook et al.
6,631,759 B2 10/2003 Cook et al.
6,631,760 B2 10/2003 Cook et al.
6,631,769 B2 10/2003 Cook et al.
6,668,930 B2 12/2003 Hoffman
6,684,947 B2 2/2004 Cook et al.
6,705,395 B2 3/2004 Cook et al.
6,712,154 B2 3/2004 Cook et al.
6,725,919 B2 4/2004 Cook et al.
6,739,392 B2 5/2004 Cook et al.
6,745,845 B2 6/2004 Cook et al.
6,758,278 B2 7/2004 Cook et al.
6,823,937 B1 11/2004 Cook et al.
6,857,473 B2 2/2005 Cook et al.
6,892,819 B2 5/2005 Cook et al.
6,966,370 B2 11/2005 Cook et al.

(Continued)

*Primary Examiner* — Kenneth L Thompson
*Assistant Examiner* — Steven MacDonald
(74) *Attorney, Agent, or Firm* — Steve Rosenblatt

(57) ABSTRACT

An additional string is run through an existing string using a running string. With the strings overlapping an upper inflatable secures them together leaving gaps. The upper inflatable creates an upper expanded zone where the swage assembly is then built. The swage assembly has a seal and upon pressure being applied between the upper inflatable and the seal the swage assembly releases the running string and is pushed to expand the additional string until tagging a cement shoe. The running string is rejoined to the swage assembly and after cementing a lower inflatable is deployed to make a bell and to set an external packer if used. If there is an external packer the shoe releases and on the way out of the hole the upper inflatable sets a seal in the lap.

23 Claims, 8 Drawing Sheets

(56) References Cited

U.S. PATENT DOCUMENTS

| | | | | |
|---|---|---|---|---|
| 6,968,618 | B2 | 11/2005 | Cook et al. | |
| 6,976,541 | B2 | 12/2005 | Brisco et al. | |
| 7,017,670 | B2 * | 3/2006 | Hazel et al. | 166/382 |
| 7,021,390 | B2 | 4/2006 | Cook et al. | |
| 7,036,582 | B2 | 5/2006 | Cook et al. | |
| 7,040,396 | B2 | 5/2006 | Cook et al. | |
| 7,044,218 | B2 | 5/2006 | Cook et al. | |
| 7,044,221 | B2 | 5/2006 | Cook et al. | |
| 7,048,067 | B1 | 5/2006 | Cook et al. | |
| 7,055,608 | B2 | 6/2006 | Cook et al. | |
| 7,063,142 | B2 | 6/2006 | Cook et al. | |
| 7,077,211 | B2 | 7/2006 | Cook et al. | |
| 7,077,213 | B2 | 7/2006 | Cook et al. | |
| 7,086,475 | B2 | 8/2006 | Cook | |
| 7,100,684 | B2 | 9/2006 | Cook et al. | |
| 7,100,685 | B2 | 9/2006 | Cook et al. | |
| 7,104,322 | B2 * | 9/2006 | Whanger et al. | 166/277 |
| 7,108,061 | B2 | 9/2006 | Cook et al. | |
| 7,108,072 | B2 | 9/2006 | Cook et al. | |
| 7,121,337 | B2 | 10/2006 | Cook et al. | |
| 7,121,352 | B2 | 10/2006 | Cook et al. | |
| 7,146,702 | B2 | 12/2006 | Cook et al. | |
| 7,147,053 | B2 | 12/2006 | Cook et al. | |
| 7,159,665 | B2 | 1/2007 | Cook et al. | |
| 7,159,667 | B2 | 1/2007 | Cook et al. | |
| 7,168,499 | B2 | 1/2007 | Cook et al. | |
| 7,172,019 | B2 | 2/2007 | Cook et al. | |
| 7,172,021 | B2 | 2/2007 | Brisco et al. | |
| 7,172,024 | B2 | 2/2007 | Cook et al. | |
| 7,174,964 | B2 | 2/2007 | Cook et al. | |
| 7,185,710 | B2 | 3/2007 | Cook et al. | |
| 7,195,061 | B2 | 3/2007 | Cook et al. | |
| 7,195,064 | B2 | 3/2007 | Cook et al. | |
| 7,198,100 | B2 | 4/2007 | Cook et al. | |
| 7,201,223 | B2 | 4/2007 | Cook et al. | |
| 7,204,007 | B2 | 4/2007 | Cook et al. | |
| 7,216,701 | B2 | 5/2007 | Cook et al. | |
| 7,231,985 | B2 | 6/2007 | Cook et al. | |
| 7,234,531 | B2 | 6/2007 | Kendziora et al. | |
| 7,240,728 | B2 | 7/2007 | Cook et al. | |
| 7,240,729 | B2 | 7/2007 | Cook et al. | |
| 7,240,731 | B2 | 7/2007 | Carmody et al. | |
| 7,246,667 | B2 | 7/2007 | Cook et al. | |
| 7,255,176 | B2 | 8/2007 | Adam et al. | |
| 7,258,168 | B2 | 8/2007 | Cook et al. | |
| 7,270,188 | B2 | 9/2007 | Cook et al. | |
| 7,290,616 | B2 | 11/2007 | Cook et al. | |
| 7,299,881 | B2 | 11/2007 | Cook et al. | |
| 7,308,755 | B2 | 12/2007 | Cook et al. | |
| 7,325,602 | B2 | 2/2008 | Cook et al. | |
| 7,350,564 | B2 | 4/2008 | Cook et al. | |
| 7,357,188 | B1 | 4/2008 | Cook et al. | |
| 7,357,190 | B2 | 4/2008 | Cook et al. | |
| 7,363,691 | B2 | 4/2008 | Cook et al. | |
| 7,367,389 | B2 * | 5/2008 | Duggan et al. | 166/207 |
| 7,370,699 | B2 | 5/2008 | Adam et al. | |
| 7,380,604 | B2 | 6/2008 | Adam et al. | |
| 7,410,000 | B2 | 8/2008 | Cook et al. | |
| 7,416,027 | B2 | 8/2008 | Ring et al. | |
| 7,419,009 | B2 | 9/2008 | Cook et al. | |
| 7,434,618 | B2 | 10/2008 | Cook et al. | |
| 7,438,132 | B2 | 10/2008 | Cook et al. | |
| 7,458,422 | B2 | 12/2008 | Adam et al. | |
| 7,516,790 | B2 | 4/2009 | Cook et al. | |
| 7,546,881 | B2 | 6/2009 | Lloyd et al. | |
| 7,552,772 | B2 | 6/2009 | Carmody et al. | |
| 7,556,092 | B2 | 7/2009 | Cook et al. | |
| 7,603,758 | B2 | 10/2009 | Cook et al. | |
| 7,665,532 | B2 | 2/2010 | Cook et al. | |
| 7,708,060 | B2 | 5/2010 | Adam et al. | |
| 7,730,955 | B2 | 6/2010 | Farquhar et al. | |
| 7,740,076 | B2 | 6/2010 | Costa et al. | |
| 2002/0166668 | A1 * | 11/2002 | Metcalfe et al. | 166/378 |
| 2005/0023001 | A1 * | 2/2005 | Hillis | 166/380 |
| 2005/0056433 | A1 * | 3/2005 | Ring et al. | 166/384 |
| 2010/0032167 | A1 * | 2/2010 | Adam et al. | 166/382 |
| 2010/0132952 | A1 * | 6/2010 | Nicolas et al. | 166/369 |
| 2010/0193124 | A1 * | 8/2010 | Nicolas et al. | 156/294 |

* cited by examiner

INTEGRATED CONTINUOUS LINER EXPANSION METHOD

FIELD OF THE INVENTION

The field of the invention is a method to produce a monobore and more particularly running in a string with a cement shoe and supporting it to an existing string by liner top expansion which makes room to build a swage and drive the swage with applied pressure to the cement shoe. A bell is formed at the lower end of the liner and the liner top is sealed as the inner assembly is pulled after cementing is concluded

BACKGROUND OF THE INVENTION

Monobore wells have a constant diameter for a given interval that is made up of multiple strings. Typically the existing string has an enlarged segment or bell into which the next string will be supported and then sealed after cementing, in the case of cemented wellbores. The newly added string has to be expanded and in some applications cemented and there needs to be a bell at the lower end of the added string so as to accommodate the next string and retain the monobore nature of the wellbore. The liner is first supported in the bell of the existing string leaving gaps to allow fluid displacement during cementing and those gaps are closed after cementing is completed.

The general description of the above procedure is optimized by finding ways to perform the needed steps to deliver, support, expand, cement and seal the liner to an existing tubular in as few trips as possible and ideally in a single trip.

One attempt at such a method is described in US Publication 2010/0032167. In one technique in this reference the swage assembly is pumped in a downhole direction for part of the expansion until a cement shoe is tagged. The running string is rejoined to the swage assembly for cementing. Subsequently the swage assembly is driven uphole to support and seal the newly added liner that had previously been supported from the hole bottom. After that the shoe has to be drilled out. There is no discussion of how the lower end of the recently cemented liner is to be belled out because the method described there is not for making a monobore but rather reduces the well diameter with each successive string. In an alternative embodiment the swage assembly is built just above the cement shoe and driven uphole to expand the liner. After cementing with the running string and swage assembly latched to the shoe, the swage assembly is released from the shoe and propelled with pressure from below while retained to the running string to finish the expansion at the liner top to secure and seal the liner to the existing tubular.

Various techniques have been developed to expand liners and attach them to existing casing already in the wellbore. Some of these techniques involve running a liner with a wide bell at the bottom where the expansion equipment is located and then driving the swage up the liner and out the top and along the way setting external seals to the surrounding casing as the swage makes an exit. One such process is shown in U.S. Pat. No. 6,470,966. The extensive list of prior art included in that patent is representative of the state of the art in downhole tubular expansion techniques that include attachment to an existing tubular. Other patents show the use of swages that include a series of retractable rollers that can be radially extended downhole to initiate a tubular expansion such as of a casing patch as for example is illustrated in U.S. Pat. No. 6,668,930. Some devices swage in a top to bottom direction as illustrated in U.S. Pat. No. 6,705,395.

Another approach is illustrated in an application entitled Pump Down Swage Expansion Method (by some of the inventors of this application) filed Oct. 8, 2010 and having a Ser. No. 12/901,122. That application uses a running string and liner peripheral seals to move a swage assembly for gaining liner support. It continues in that mode with building another swage after support of the liner in the existing tubular. In the same trip the shoe is secured and the liner cemented followed by engaging the seal of the liner hanger with manipulation of the running string. The swage assembly remains connected to the running string during expansion.

Methods that mechanically advance a swage through a tubular require the rig equipment to not only support the weight of the string to be expanded but also to be able to handle the applied force to the swage to advance it through the tubular to enlarge the diameter. This reference, identified in the previous paragraph, reduces the surface equipment capacities needed to perform an expansion to complete a well. The method features a top down expansion using a plurality of adjustable swages that get built at different times and that are driven from applied annulus pressure delivered around a workstring. The tubular to be expanded is placed in an overlapping position with an existing tubular. The swage assembly is pushed on a guide extending from the running string by virtue of a cup seal around the running string and another peripheral seal on the top of the liner to be expanded to prevent pressure bypassing as the swage assembly is run into the liner string to support the liner without sealing it. A further swage is built in the liner at a location below the support point to the existing liner and the balance of the liner is expanded to bottom while engaging the cement shoe as the swage assembly leaves the lower end of the now expanded liner. The shoe is repositioned and set at the lower end of the expanded liner and a cement job follows with a subsequent reversing out of excess cement. The swage assembly is pulled through the liner and another swage is built before it is pushed down through the liner top to set the seal of the liner hanger or optionally to go though past the slips of the liner hanger to create a constant drift though the expanded liner top. The assembly is removed.

Monobore applications using expansion have integrated cementing through a shoe while covering a recess at the end of an existing string with a removable cover that comes off after cementing. A string with a swage is placed in position and the swage is energized to grow in diameter before being advanced through the newly added tubular until the swage exits the top of the added tubular to fixate it into the recess at the lower end of the existing tubular. The result is a monobore well. These designs have also disclosed a deployable shoe that can be delivered with the string prior to expansion and then tagged and retained as a swage moves through the string only to be reintroduced into the expanded string and sealingly fixated to it for the cementing operation. Examples of one or more of these method steps are illustrated in U.S. Pat. Nos. 7,730,955; 7,708,060; 7,552,772; 7,458,422; 7,380,604; 7,370,699; 7,255,176 and 7,240,731. Other patents relating to expansion by moving a cone uphole from within a bell at a lower end of a liner to be supported to a recess in existing tubing and creating a monobore as well as expansion of tubulars downhole are as follows: 6,712,154; 7,185,710; 7,410,000; 7,350,564; 7,100,684; 7,195,064; 7,258,168; 7,416,027; 7,290,616; 7,121,352; 7,234,531; 7,740,076; 7,100,685; 7,556,092; 7,516,790; 7,546,881; 6,328,113; 7,086,475; 6,745,845; 6,575,240; 6,725,919; 6,758,278; 6,739,392; 7,201,223; 7,204,007; 7,172,019; 7,325,602; 7,363,691; 7,146,702; 7,172,024; 7,308,755; 6,568,471; 6,966,370; 7,419,009; 7,040,396; 6,684,947; 6,631,769;

6,631,759; 7,063,142; 6,705,395; 7,044,221; 6,857,473; 7,077,213; 7,036,582; 7,603,758; 7,108,061; 6,631,760; 6,561,227; 7,159,665; 7,021,390; 6,892,819; 7,246,667; 7,174,964; 6,823,937; 7,147,053; 7,299,881; 7,231,985; 7,168,499; 7,270,188; 7,357,190; 7,044,218; 7,357,188; 7,665,532; 7,121,337; 7,434,618; 7,240,729; 7,077,211; 7,195,061; 7,198,100; 6,640,903; 7,438,132; 7,055,608; 7,240,728; 7,216,701; 6,604,763; 6,968,618; 7,172,021; 7,048,067; 6,976,541; 7,159,667; 7,108,072 and 6,55,7640.

What is needed and provided by the method of the present invention is a way to introduce a string with a cementing shoe into a wellbore with an existing tubular with a lower end bell and add strings in a monobore completion where each string can be supported, expanded, optionally cemented and sealed to the bell of the existing tubular while leaving a lower end bell on the recently added tubular so that the process can be repeated for the particular zone or interval. Those skilled in the art will more readily appreciate additional aspects of the invention from the detailed description of the preferred embodiment and the associated drawings while understanding that the full scope of the invention is to be determined from the literal and equivalent scope of the appended claims.

SUMMARY OF THE INVENTION

A liner string is run into position on a running string. The assembly features a cement shoe retained at a lower end and an external isolation device. At the upper end is a hanger and seal on the outside of the liner and internally is an inflatable which has supported below it a buildable swage assembly that can selectively be detached from the upper inflatable and an associated packer cup to allow driving the swage with pressure applied in a downhole direction after release from the upper inflatable. The upper inflatable sets the hanger at the liner top and expands a portion near the liner top. The swage assembly is built in the recently expanded liner top and then released from the running string to tag into the shoe. The running string is reconnected to allow cementing through the swage assembly and the shoe. A lower inflatable around the shoe and within the liner is expanded to set the external seal before the cement sets. This allows the lower inflatable to be deflated with the running string attached to the shoe and no cement flow back because the external seal has been set. Setting the external seal is coincident with creating a lower end bell in the liner. The running string can then pull out the swage assembly and shoe with the lower inflatable out of the liner. On the way out of the liner the upper inflatable sets a seal adjacent to the already set slips and the bottom hole assembly is pulled leaving a monobore down to the lower end of the liner that now has a bell for the next string to be attached to extend the monobore.

DETAILED DESCRIPTION OF THE PREFERRED EMBODIMENT

Figure 1:
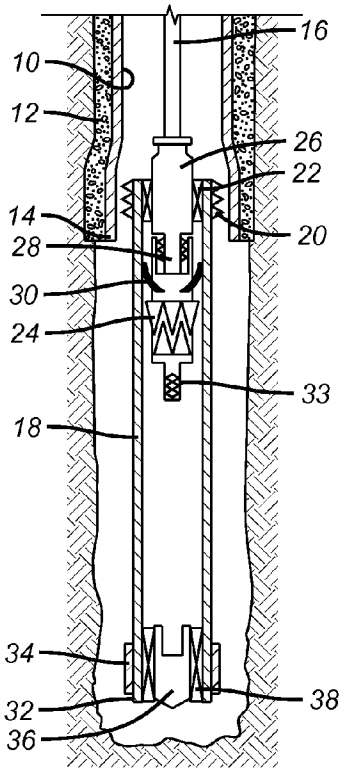
FIG. 1 illustrates running in the liner to overlap with the lower end of the existing tubular in an embodiment with an external lower end packer where the shoe will be retrieved.
Figure 2:
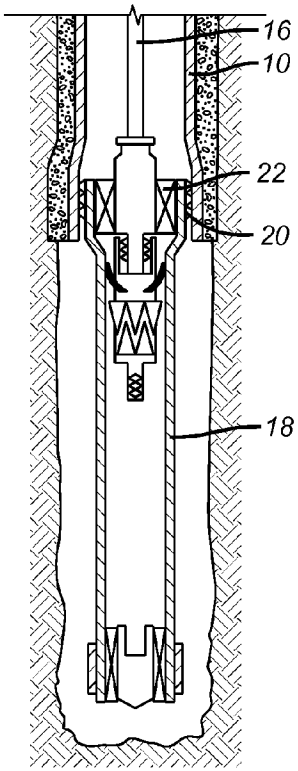
FIG. 2 is the view of FIG. 1 showing the upper inflatable securing the hanger at the upper end of the liner being run.
Figure 3:
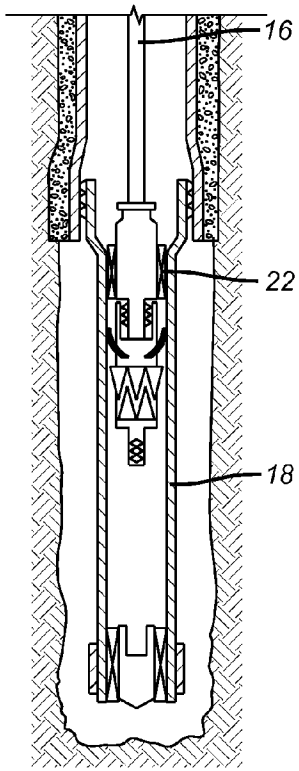
FIG. 3 is the view of FIG. 2 showing the upper inflatable deflated and shifted lower for sequential inflation and deflation with movement to create an expanded zone below the set hanger.
Figure 4:
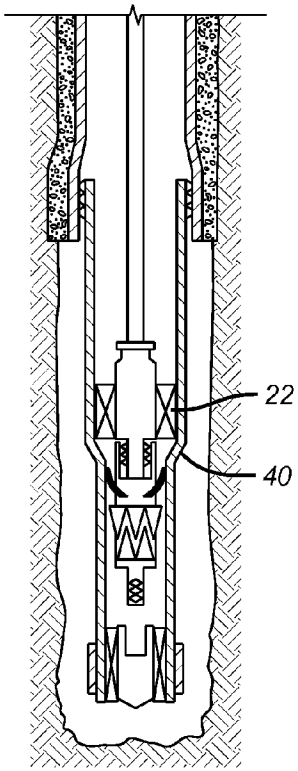
FIG. 4 is the view of FIG. 3 showing the sequential movement and inflation and deflation used to create the upper expanded zone in the liner.
Figure 5:
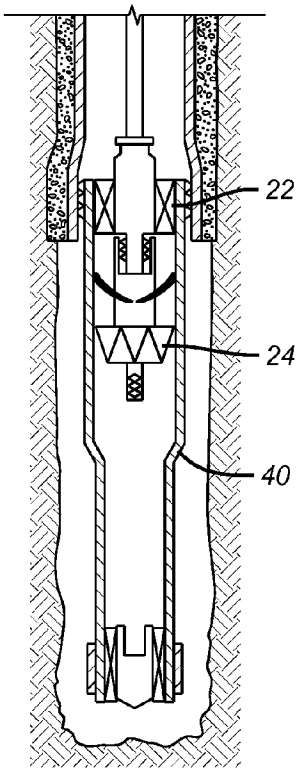
FIG. 5 is the view of FIG. 4 showing the swage assembly raised into the recently expanded zone so that the swage assembly can be built.

FIG. 1 shows a casing 10 which has been cemented at 12. At the lower end 14 a running string 16 supports a liner or tubular string 18. Item 20 schematically represents slips and a sealing element that will be set in sequence with the slips being set first to support liner 18 to the casing 10, as will be explained below. For run in the liner 18 is releasably supported to the running string 16 by a breakable member such as a shear pin that is not shown that can be broken by the actuation of the upper inflatable isolator 22 that is shown deflated for run-in in FIG. 1. Alternatively, the release could be controlled directly by pressure such as a piston releasing slips or dogs. A swage assembly 24 is releasably supported from mandrel 26 of the upper inflatable 22 by virtue of connection 28. Connection 28 can release and re-latch as will be explained below. Between the swage assembly 24 and the connection 28 is a resilient seal such as a packer cup open in an uphole direction denoted as 30.

Figures 11, 12, 13, 14:
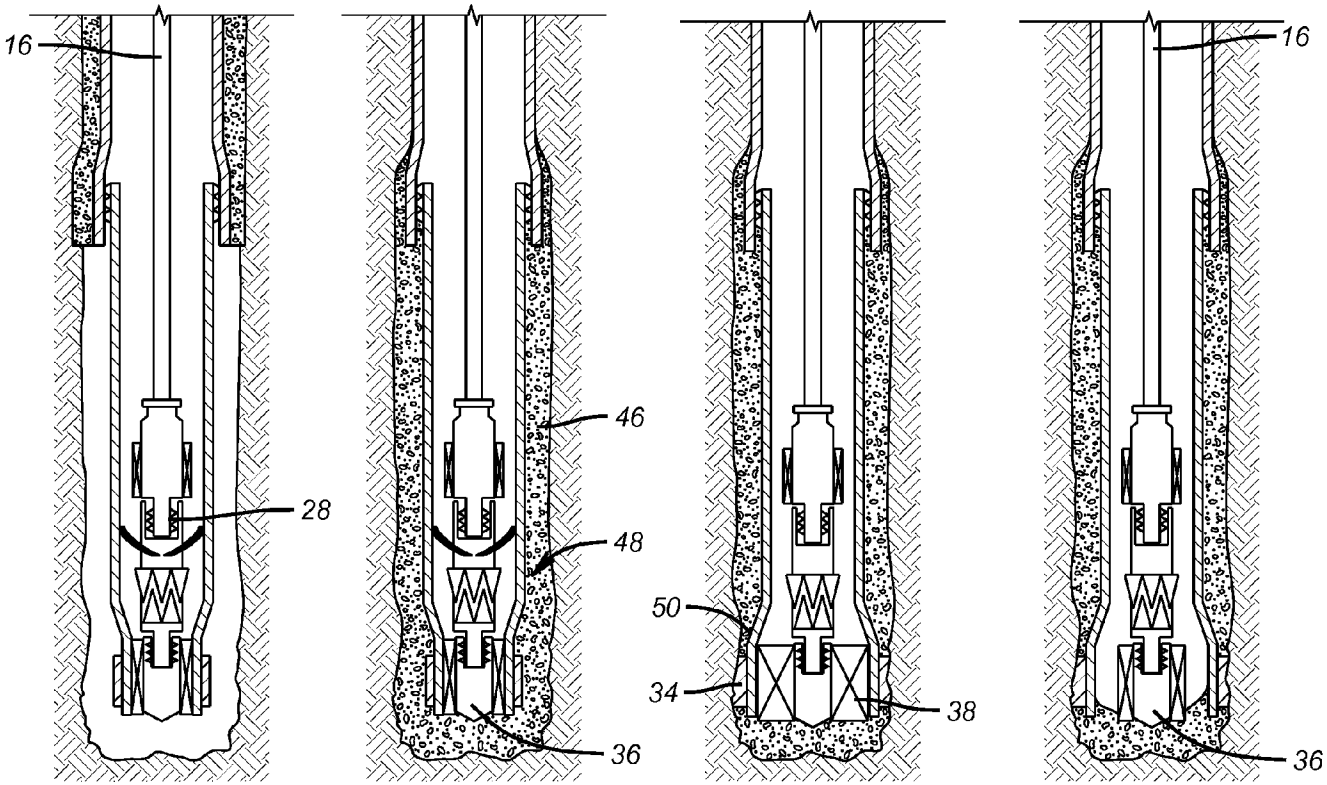
FIG. 11 is the view of FIG. 10 showing the running string tagged into the swage assembly so that cementing can begin.
FIG. 12 is the view of FIG. 11 shown after the cement has been delivered through the show and into the surrounding annular space about the liner.
FIG. 13 is the view of FIG. 12 showing the lower inflatable expanded to set the external packer and to create a bell at the lower end of the liner.
FIG. 14 is the view of FIG. 13 showing the lower inflatable deflated to allow the running string to be pulled out of the hole.

At the lower end 32 of liner 18 is an external open hole packer 34 and internally is a cement shoe 36 that is temporarily retained to the liner 18 by a breakable member such as one or more shear pins that are not shown. Surrounding the shoe 36 is a lower inflatable isolator 38 shown deflated for run-in in FIG. 1. Actuation of the lower inflatable 38 releases the shoe 36 from the liner 18 and creates a lower end bell as shown in FIG. 13. Such actuation also sets the open hole packer in the already pumped cement as will be explained later with regard to FIG. 13.

Figures 6, 7, 8, 9, 10:
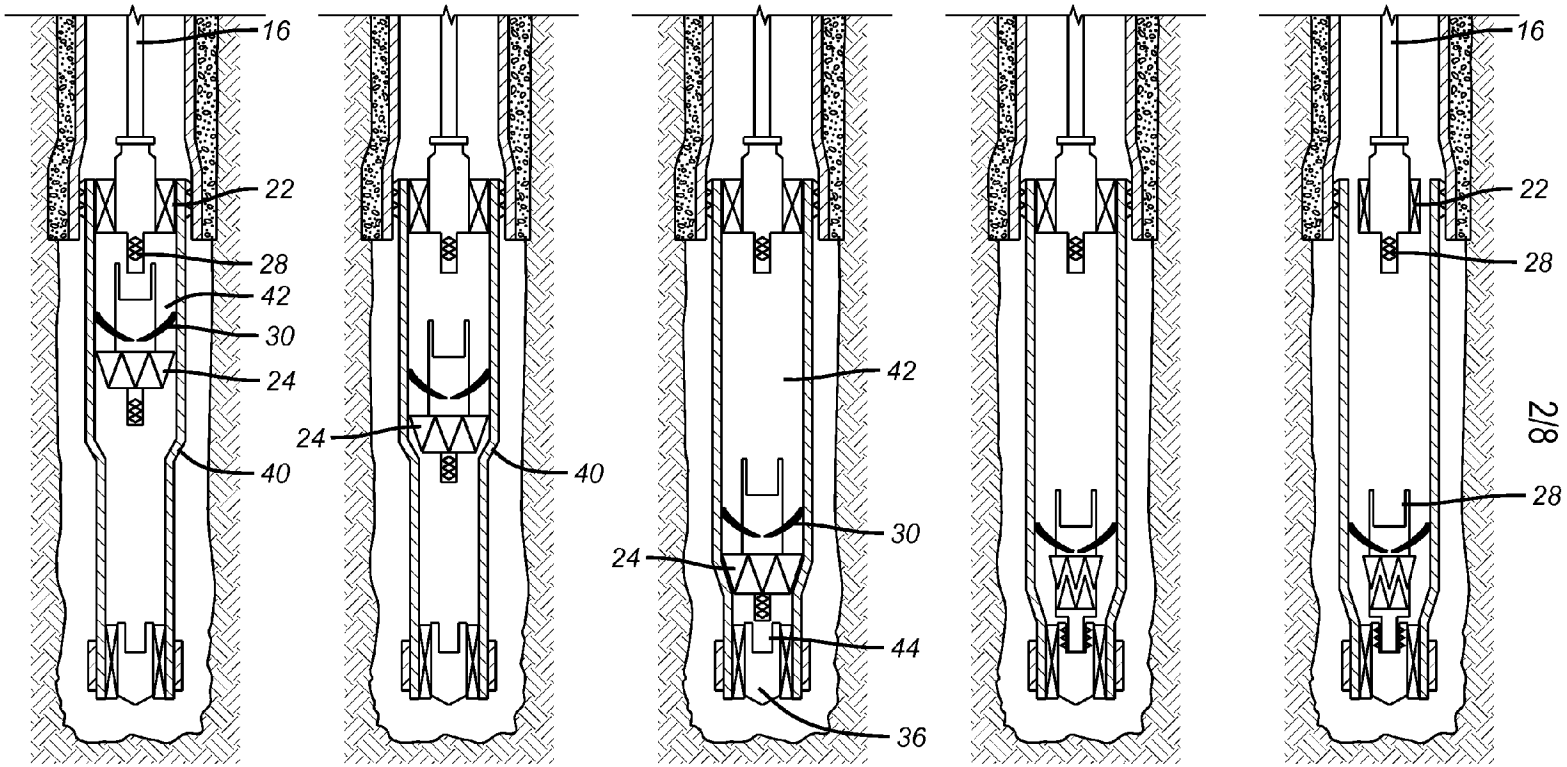
FIG. 6 is the view of FIG. 5 showing the swage assembly built and released from the running string so that pressure from above onto the associated packer cup will drive the swage assembly.
FIG. 7 is the view of FIG. 6 showing the swage assembly bottoming out in the zone expanded with the upper inflatable.
FIG. 8 is the view of FIG. 7 showing the swage assembly continuing the liner expansion to a point just short of tagging into the cement shoe.
FIG. 9 is the view of FIG. 8 showing the swage assembly tagged into the shoe at the lower end of the liner.
FIG. 10 is the view of FIG. 9 showing the upper inflatable released to allow the running string to be lowered.
Figures 15, 16, 17, 18:
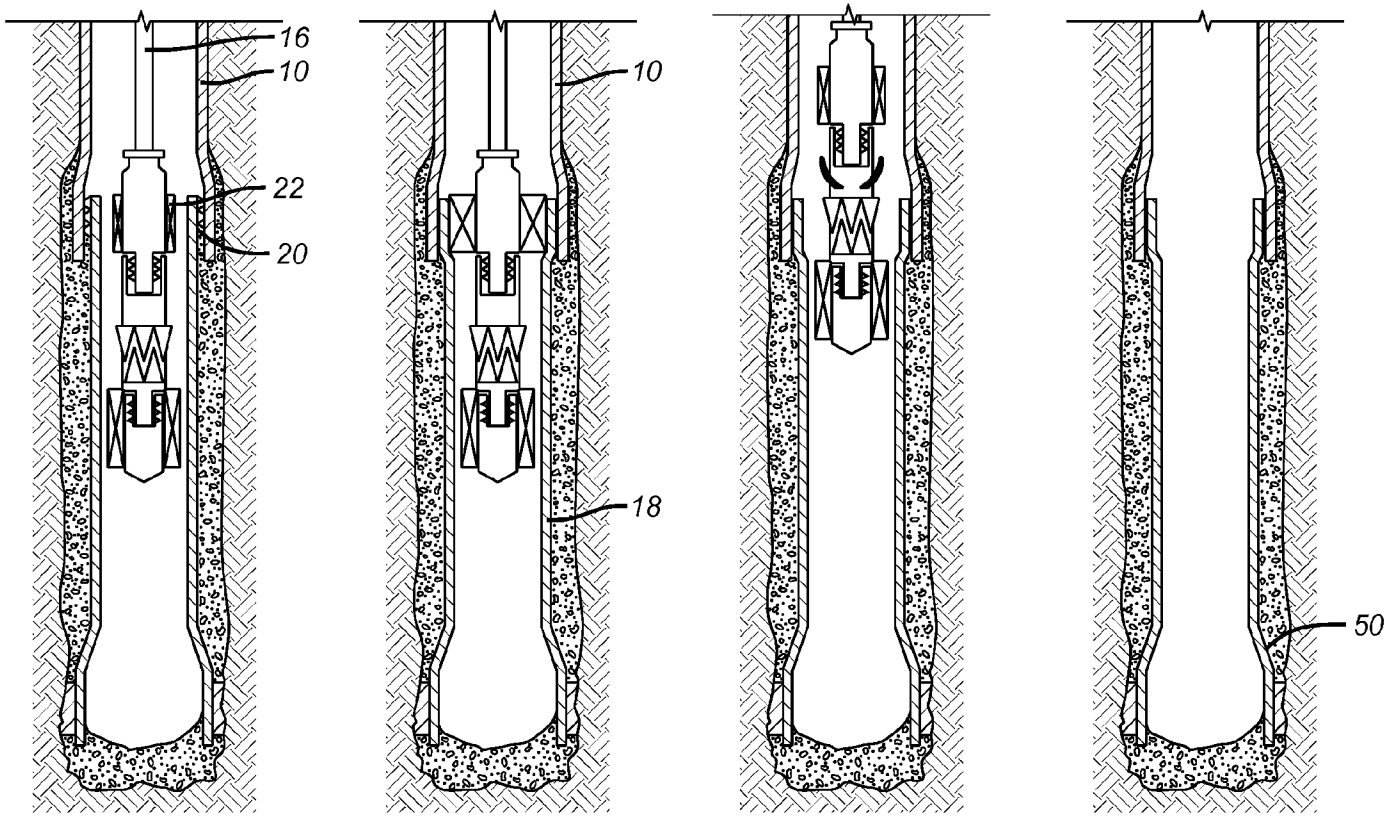
FIG. 15 is the view of FIG. 14 showing the upper inflatable aligned with the hanger and ready to set the external seal.
FIG. 16 is the view of FIG. 15 showing the upper inflatable setting the seal to the existing tubular by expansion of the upper end of the liner.
FIG. 17 is the view of FIG. 16 showing the removal of the upper and lower inflatable seals and the swage assembly from the wellbore.
FIG. 18 is the view of FIG. 17 showing the wellbore after the removal of the upper and lower inflatable seals and the swage assembly.
Figure 23:
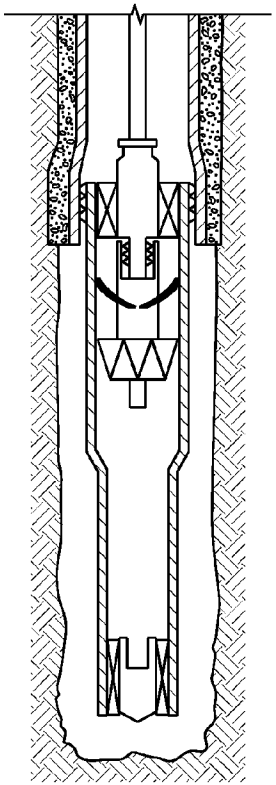
FIG. 23 is the view of FIG. 22 showing the swage assembly repositioned into the recently expanded portion of the liner.
Figure 22:
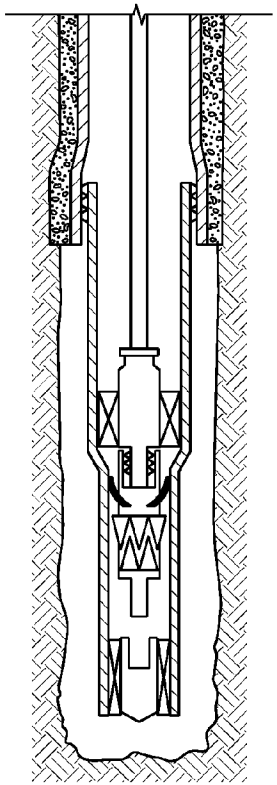
FIG. 22 is the view of FIG. 21 showing expansion of the upper portion of the liner with the upper inflatable using a sequence of inflation/deflation/relocation steps.
Figure 21:
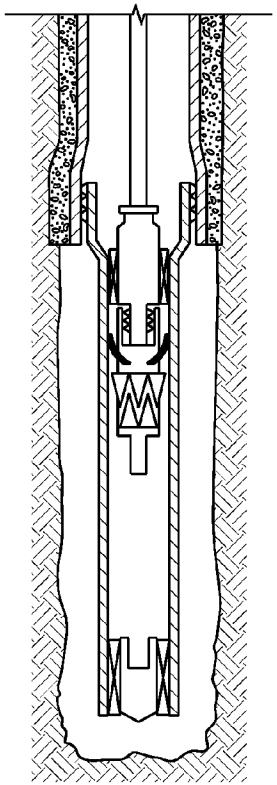
FIG. 21 shows the upper inflatable deflated and repositioned to start expanding the upper end of the liner.
Figure 20:
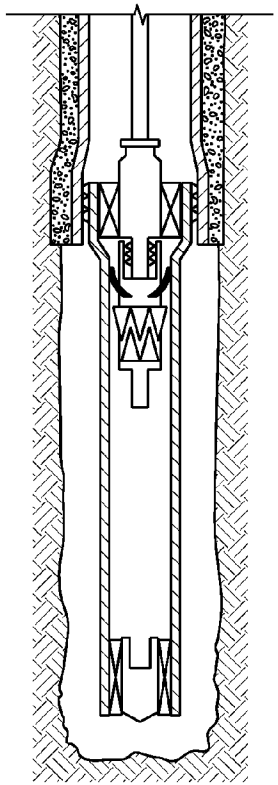
FIG. 20 is the view of FIG. 19 with the upper inflatable actuated to hang the liner to the existing tubular.
Figure 19:
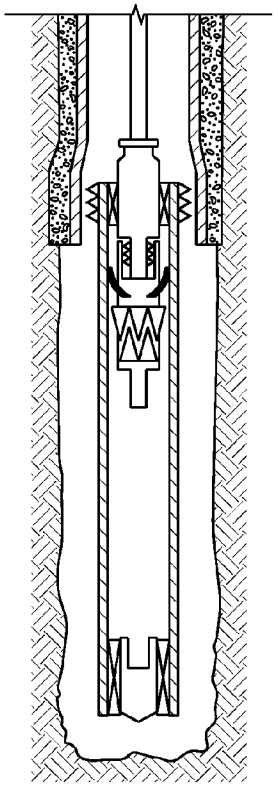
FIG. 19 is an alternative embodiment to that of FIG. 1 shown being run into the wellbore with the difference being the absence of an external seal at the lower end of the liner being run in that is not needed if the cement shoe is left in place after cementing.
Figure 27:
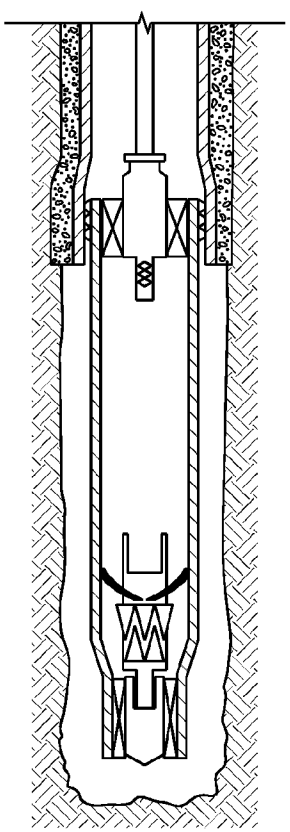
FIG. 27 is the view of FIG. 26 showing the swage assembly tagged into the cement shoe.
Figure 26:
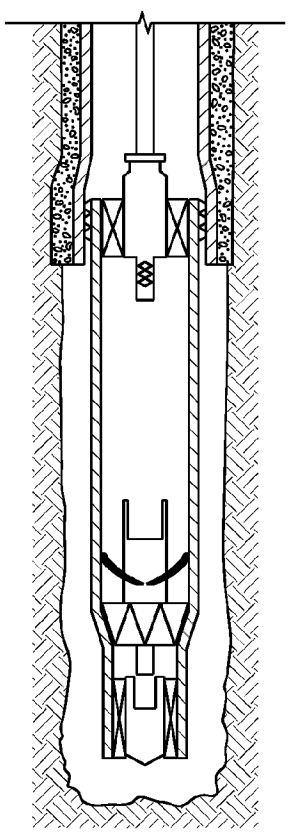
FIG. 26 is the view of FIG. 25 showing the swage assembly driven by pressure delivered through the running string with the upper inflatable set.
Figure 25:
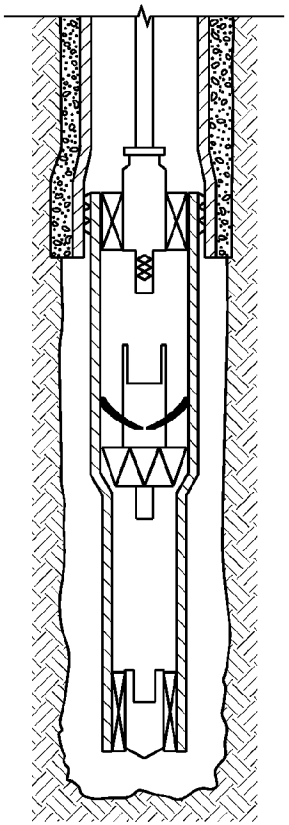
FIG. 25 is the view of FIG. 24 with the swage assembly reaching the lower end of the already expanded portion of the liner.
Figure 24:
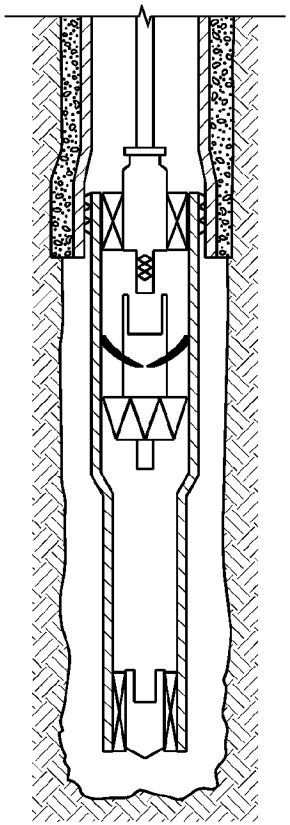
FIG. 24 is the view of FIG. 23 showing the swage assembly released from the running string and moving to the lower end of the already expanded portion of the liner.
Figure 31:
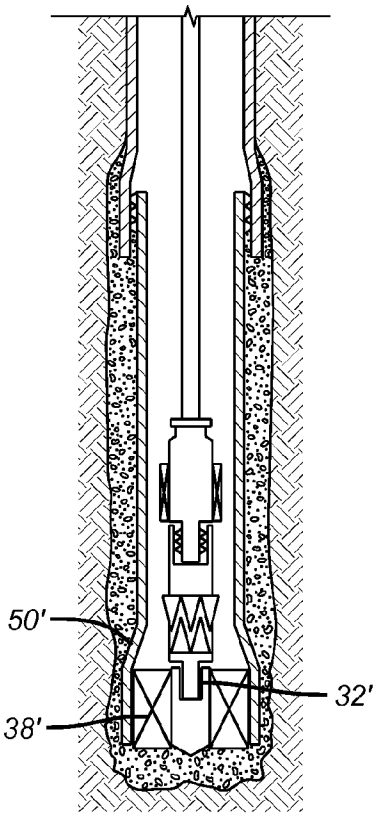
FIG. 31 is the view of FIG. 30 showing the lower inflatable set to make a lower end bell in the liner.

FIG. 7 shows the swage assembly progressed to transition location 40 with pressure into chamber 42 and to some extend its own weight so that further expansion can then start. FIG. 8 shows the volume of chamber 42 growing as the expansion with pressure on the swage assembly 24 drives it using the attached seal 30. At the end of the expansion in this manner the latch 33 will land in receptacle 44 in shoe 36 and automatically collapse the swage assembly 24 to its run in diameter upon connection to receptacle 44, as shown in FIG. 9. The automatic collapse operation can be initiated by geometrical mating such as collet/profile matching or as a hydraulic result of seals from the swage assembly 24 stabbing into a seal profile in receptacle 44. As the swage assembly 24 lands in the shoe 36 the pressure in the string 16 will spike giving surface personnel the signal that the shoe 36 has been tagged and that the upper inflatable 22 can now be allowed to deflate as shown in FIG. 10. The string 16 is lowered to reconnect connection 28 as is shown in FIG. 11. At this time as shown in FIG. 12 the cement 46 is delivered through the string 16 and through the shoe 36 and into the surrounding annulus 48 around the liner 18. Before the cement 46 sets the lower inflatable 38 is inflated to not only make a bell 50 but to also set the open hole packer 34. Doing this will allow the shoe 36 to be retrieved and will prevent cement flow back when the lower inflatable 38 is deflated as shown in FIG. 14. At this time any excess cement in the string 16 can be circulated out through the shoe 36 although it is not shown in the drawings. The string 16 is lifted as shown in FIG. 15 until the upper inflatable is aligned with the assembly 20 that up to this time has only had its slips set for support of the liner 18 from the casing 10. This was done so that during cementing in FIG. 12 the cement could displace fluid through the assembly 20 to allow the cement to advance in a manner known in the art. Now, as shown in FIG. 16, it is time to engage a seal of assembly 20 to the casing 10 to seal the liner 18 to the casing 10. This sealing action is schematically represented in FIG. 16 by the elimination of the assembly 22. All that remains is for the string 16 to be pulled out of the well and take with it the entire bottom hole assembly as shown in FIG. 17 which then leaves a monobore shown in FIG. 18 with a lower end bell 50 ready to receive the next liner string that is not shown after the well is drilled deeper. This process repeats to well bottom to produce the monobore.

FIG. 7 shows the swage assembly progressed to transition location 40 with pressure into chamber 42 and to some extend its own weight so that further expansion can then start. FIG. 8 shows the volume of chamber 42 growing as the expansion with pressure on the swage assembly 24 drives it using the attached seal 30. At the end of the expansion in this manner the latch 32 will land in receptacle 44 in shoe 36 and automatically collapse the swage assembly 24 to its run in diameter upon connection to receptacle 44, as shown in FIG. 9. The automatic collapse operation can be initiated by geometrical mating such as collet/profile matching or as a hydraulic result of seals from the swage assembly 24 stabbing into a seal profile in receptacle 44. As the swage assembly 24 lands in the shoe 36 the pressure in the string 16 will spike giving surface personnel the signal that the shoe 36 has been tagged and that the upper inflatable 22 can now be allowed to deflate as shown in FIG. 10. The string 16 is lowered to reconnect connection 28 as is shown in FIG. 11. At this time as shown in FIG. 12 the cement 46 is delivered through the string 16 and through the shoe 36 and into the surrounding annulus 48 around the liner 18. Before the cement 46 sets the lower inflatable 38 is inflated to not only make a bell 50 but to also set the open hole packer 34. Doing this will allow the shoe 36 to be retrieved and will prevent cement flow back when the lower inflatable 38 is deflated as shown in FIG. 14. At this time any excess cement in the string 16 can be circulated out through the shoe 36 although it is not shown in the drawings. The string 16 is lifted as shown in FIG. 15 until the upper inflatable is aligned with the assembly 20 that up to this time has only had its slips set for support of the liner 18 from the casing 10. This was done so that during cementing in FIG. 12 the cement could displace fluid through the assembly 20 to allow the cement to advance in a manner known in the art. Now, as shown in FIG. 16, it is time to engage a seal of assembly 20 to the casing 10 to seal the liner 18 to the casing 10. This sealing action is schematically represented in FIG. 16 by the elimination of the assembly 22. All that remains is for the string 16 to be pulled out of the well and take with it the entire bottom hole assembly as shown in FIG. 17 which then leaves a monobore shown in FIG. 18 with a lower end bell 50 ready to receive the next liner string that is not shown after the well is drilled deeper. This process repeats to well bottom to produce the monobore.

Figure 30:
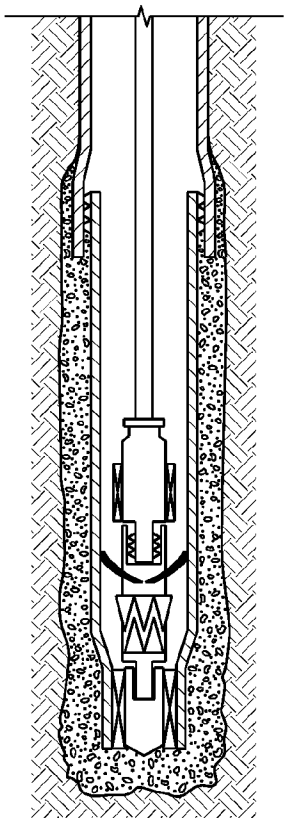
FIG. 30 is the view of FIG. 29 showing the cement delivered through the shoe and going up the outer annulus around the expanded liner.
Figure 29:
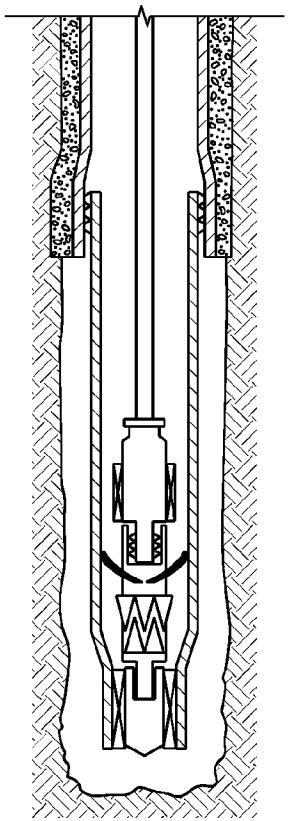
FIG. 29 is the view of FIG. 28 showing the running string reconnected to the swage assembly so that cementing can begin.
Figure 28:
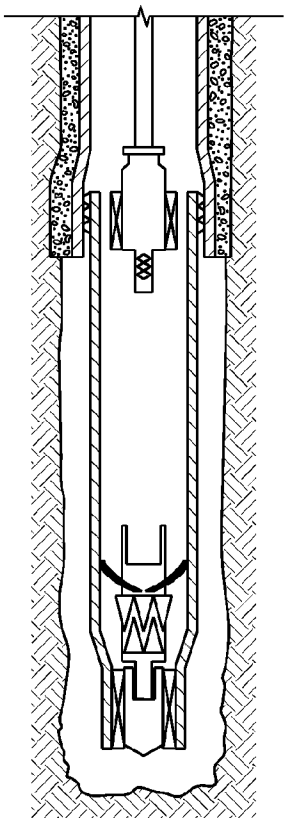
FIG. 28 is the view of FIG. 27 showing the upper inflatable deflated.
Figure 35:
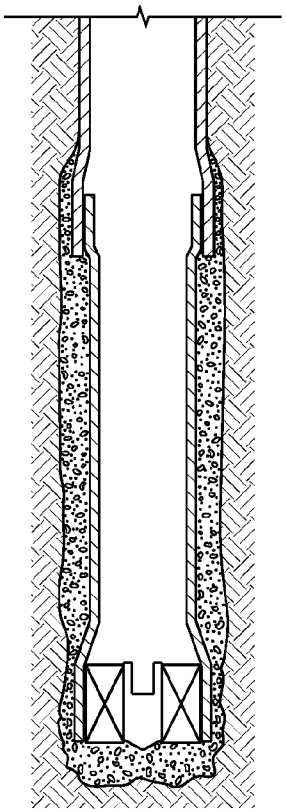
FIG. 35 is the view of FIG. 34 showing the wellbore after removal of the running string, the upper inflatable and the swage assembly from the liner.
Figure 34:
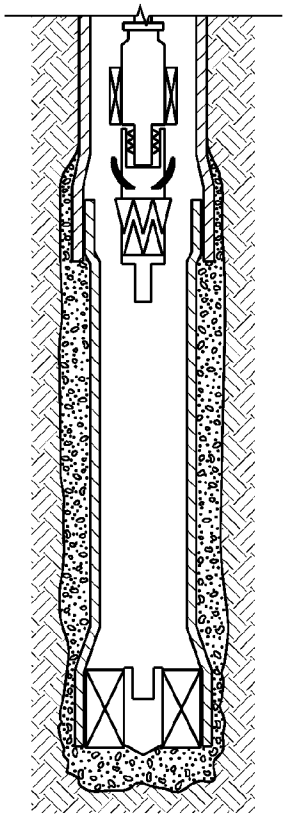
FIG. 34 is the view of FIG. 33 showing the running string removing the upper inflatable and swage assembly from the wellbore.
Figure 33:
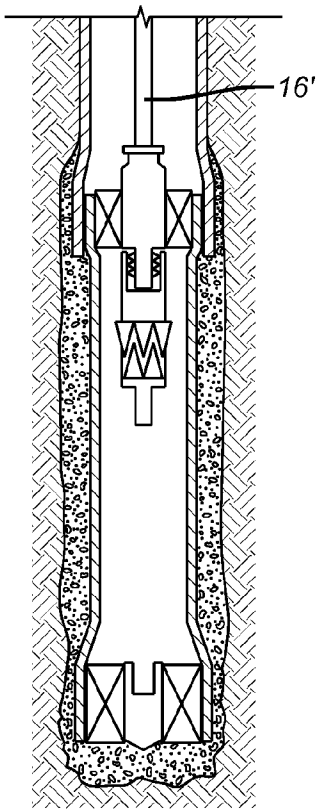
FIG. 33 is the view of FIG. 32 showing the upper inflatable in position and inflated to seat the upper seal on the liner.
Figure 32:
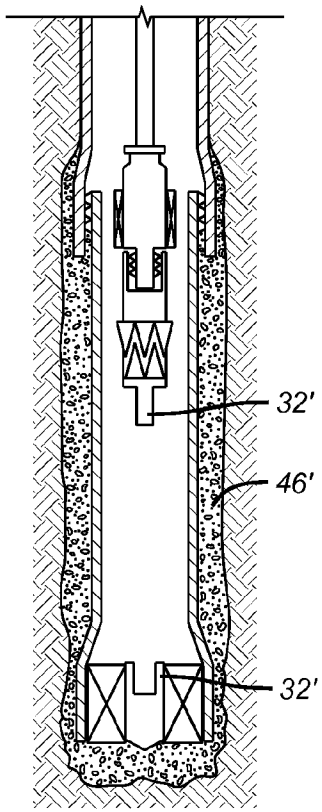
FIG. 32 is the view of FIG. 31 showing the running string being pulled leaving the shoe and lower inflatable as the cement sets.

FIGS. 19-35 are similar to FIGS. 1-18 but differ in that there is no open hole packer 34 used on the liner 18. Because of that, after the cement is pumped in FIG. 30 and the lower inflatable 38' is inflated to make bell 50' the connection 32' releases as seen in FIG. 32 and the lower inflatable 38' stays inflated until the cement 46' sets. Excess cement 46 in the string 16' can be circulated out through connection 32' as the string 16' is pulled as shown in FIGS. 33 and 34. After the cement has hardened, the lower inflatable 38' will be drilled up before proceeding into the next zone similar to a common cement retainer. In other respects the sequence in FIGS. 19-35 is the same as in FIGS. 1-18.

Although the preferred isolation and expansion devices at the upper and lower ends of the liner 18 are indicated as inflatables 22 and 38, other devices that can seal and expand against the liner 18 are contemplated such as mechanically or hydraulically set packers or spaced opposed seals forming a straddle tool wherein the gap between the seals can be pressurized for expansion of a tubular between the seals, to mention a few examples. The temporary retaining devices can be shear pins or rings or other frangible retainers. Optionally, one or more isolation and expansion devices can be used.

The above description is illustrative of the preferred embodiment and many modifications may be made by those skilled in the art without departing from the invention whose scope is to be determined from the literal and equivalent scope of the claims below.

We claim:

1. A completion method for a subterranean location, comprising:

running in, through an existing string, an additional tubular string using a running string;

passing said additional tubular string through said existing string so that the upper end of said additional tubular string laps the lower end of said existing string;

in one trip that encompasses said running in and said passing, further securing said additional tubular string to the existing string, expanding said additional tubular string to a lower end of said additional tubular string with a swage assembly;

providing at least one isolator in said additional tubular string;

selectively releasing said swage assembly from said isolator and thereafter axially driving said swage assembly with applied pressure;

using said isolator to seal and expand at least a portion of said additional tubular string.

2. The method of claim 1, comprising:

building said swage assembly to an expansion dimension in a portion of said additional tubular string previously expanded by said isolator.

3. The method of claim 1, comprising:

using an inflatable as said isolator.

4. The method of claim 3, comprising:

creating an expanded zone in said additional tubular string with sequential deployment, release and repositioning of said inflatable;

initially building a swage assembly to an expansion dimension within said expanded zone.

5. A completion method for a subterranean location, comprising:

running in, through an existing string, an additional tubular string using a running string;

passing said additional tubular string through said existing string so that the upper end of said additional tubular string laps the lower end of said existing string;

in one trip that encompasses said running in and said passing, further securing said additional tubular string to the existing string, expanding said additional tubular string;

providing at least one isolator in said additional tubular string;

using said isolator to seal and expand at least a portion of said additional tubular string;

using a swage assembly for said expanding;

selectively securing said swage assembly to said running string;

building said swage assembly to an expansion dimension in a portion of said additional tubular string previously expanded by said isolator;

expanding said additional tubular string with said swage assembly released from said running string;

pressurizing a space defined between said isolator and said swage assembly to drive said swage assembly for expansion of said additional tubular string.

6. The method of claim 5, comprising:

using said isolator to secure said additional tubular string to said existing tubular at said lap with at least one gap between said tubulars at said lap.

7. The method of claim 6, comprising:

closing said gap with said isolator after cementing said additional tubular string.

8. The method of claim 7, comprising:

using an inflatable as said isolator.

9. The method of claim 5, comprising:

providing a swage assembly seal with said swage assembly to define a sealed variable volume chamber with said isolator that changes volume as pressure within said chamber drives said swage assembly.

10. The method of claim 5, comprising:

cementing in said additional tubular in said single trip.

11. A completion method for a subterranean location, comprising:

running in, through an existing string, an additional tubular string using a running string;

passing said additional tubular string through said existing string so that the upper end of said additional tubular string laps the lower end of said existing string;

in one trip that encompasses said running in and said passing, further securing said additional tubular string to the existing string, expanding said additional tubular string, and cementing said additional tubular string;

providing at least one isolator in said additional tubular string;

using said isolator to seal and expand at least a portion of said additional tubular string;

using an inflatable as said isolator;

creating an expanded zone in said additional tubular string with sequential deployment, release and repositioning of said inflatable;

initially building a swage assembly to an expansion dimension within said expanded zone;

tagging a cement shoe near a lower end of said additional tubular string with said swage assembly;

tagging the running string into said swage assembly after said swage assembly has tagged said shoe;

cementing said additional string through said running string and said shoe.

12. The method of claim 11, comprising:

providing at least an upper and a lower isolator as said at least one isolator;

supporting said cement shoe to said additional string with said lower isolator.

13. The method of claim 12, comprising:

deploying said lower isolator to expand the lower end of the additional tubular string to have a bell shape.

14. The method of claim 13, comprising:

releasing said swage assembly from said shoe after said cementing;

removing said isolators and said swage assembly together with said running string.

15. The method of claim 12, comprising:

using an inflatable for said lower isolator.

16. The method of claim 12, comprising:

setting an external packer on said additional string into cement in a surrounding annulus with said lower isolator.

17. The method of claim 16, comprising:

retracting said lower isolator after said cementing;

repositioning said upper isolator adjacent said lap;

using said upper isolator to expand a seal on said additional string against said existing string;

removing said isolators and said swage assembly and said shoe together with said running string.

18. A completion method for a subterranean location, comprising:

running in, through an existing string, an additional tubular string using a running string;

passing said additional tubular string through said existing string so that the upper end of said additional tubular string laps the lower end of said existing string;

in one trip that encompasses said running in and said passing, further securing said additional tubular string to the existing string, expanding said additional tubular string, and cementing said additional tubular string;

providing at least one isolator in said additional tubular string;

using said isolator to seal and expand at least a portion of said additional tubular string;

providing at least an upper and a lower isolator as said at least one isolator;

supporting a cement shoe to said additional string with said lower isolator.

19. The method of claim 18, comprising:

using an inflatable as said lower isolator.

20. The method of claim 19, comprising:

actuating an external packer on said additional string with said inflatable;

releasing said shoe from said additional tubular string by deflation of said inflatable while retaining said shoe with said running string;

mounting said upper inflatable on said running string;

repositioning said running string after said cementing to place said upper inflatable adjacent said lap;

inflating said upper inflatable to set a seal in said lap;

removing said inflatables, said swage assembly and said shoe with said running string.

21. The method of claim 18, comprising:

mounting said upper inflatable on said running string;

repositioning said running string after said cementing and release from said shoe to place said upper inflatable adjacent said lap;

inflating said upper inflatable to set a seal in said lap;

removing said inflatables and said swage assembly with said running string.

22. The method of claim 18, comprising:

deploying said lower isolator with said running string, after cementing through said shoe, to expand the lower end of the additional tubular string to have a bell shape.

23. A completion method for a subterranean location, comprising:

running in, through an existing string, an additional tubular string using a running string;

passing said additional tubular string through said existing string so that the upper end of said additional tubular string laps the lower end of said existing string;

in one trip that encompasses said running in and said passing, further securing said additional tubular string to the existing string, expanding said additional tubular string to a lower end of said additional tubular string;

providing at least one isolator in said additional tubular string;

using said isolator to seal and expand at least a portion of said additional tubular string;

cementing in said additional tubular in said single trip.

* * * * *